US008118693B2

(12) United States Patent
Tande

(10) Patent No.: US 8,118,693 B2
(45) Date of Patent: Feb. 21, 2012

(54) PRACTICE BAT

(76) Inventor: Alan B. Tande, Simi Valley, CA (US)

( * ) Notice: Subject to any disclaimer, the term of this patent is extended or adjusted under 35 U.S.C. 154(b) by 0 days.

(21) Appl. No.: 12/732,587

(22) Filed: Mar. 26, 2010

(65) Prior Publication Data

US 2010/0248867 A1 Sep. 30, 2010

Related U.S. Application Data

(60) Provisional application No. 61/163,707, filed on Mar. 26, 2009.

(51) Int. Cl.
*A63B 69/00* (2006.01)

(52) U.S. Cl. ..... 473/457; 473/422

(58) Field of Classification Search ..... 473/422, 473/437, 457, 558–568, 519, 521, 523, 549, 473/552, 231, 234; D21/780, 725
See application file for complete search history.

(56) References Cited

U.S. PATENT DOCUMENTS 1,168,808 A * 1/1916 Von Hoffmann ..... 124/5
3,797,472 A * 3/1974 Knisely, Jr. ..... 124/5
3,841,292 A * 10/1974 Hoffman ..... 124/5
3,897,068 A * 7/1975 Staples ..... 473/233
4,364,371 A * 12/1982 Woolard ..... 124/5
4,634,121 A * 1/1987 Sasaki ..... 473/457
4,794,905 A * 1/1989 Woolard ..... 124/5
4,809,975 A * 3/1989 Lee ..... 482/110
5,360,209 A * 11/1994 Mollica ..... 473/457
5,405,138 A * 4/1995 Duran ..... 473/234
5,590,875 A * 1/1997 Young ..... 473/457
5,776,006 A * 7/1998 Gruber ..... 473/256
D405,859 S * 2/1999 Thompson ..... D21/791
6,050,908 A * 4/2000 Muhlhausen ..... 473/457
6,338,687 B1 * 1/2002 Thompson ..... 473/453
D457,929 S * 5/2002 Ciesar et al. ..... D21/725
6,406,387 B1 * 6/2002 Ryan ..... 473/457
6,461,163 B1 * 10/2002 Gallagher et al. ..... 434/252
D480,122 S * 9/2003 Ciesar et al. ..... D21/780
D485,325 S * 1/2004 Rohan-Weaver ..... D21/789
6,949,036 B2 * 9/2005 Ciesar et al. ..... 473/457
7,048,640 B2 * 5/2006 Light ..... 473/256
7,147,580 B2 * 12/2006 Nutter et al. ..... 473/457
7,226,371 B2 * 6/2007 Leadbetter et al. ..... 473/409
7,297,078 B2 * 11/2007 Libonati ..... 473/457
7,682,267 B2 * 3/2010 Libonati ..... 473/457
2002/0055402 A1 * 5/2002 Ciesar et al. ..... 473/457
2002/0072041 A1 * 6/2002 Gallagher et al. ..... 434/252
2003/0144089 A1 * 7/2003 Ryan ..... 473/457
2004/0048696 A1 * 3/2004 Ciesar et al. ..... 473/457
2007/0293358 A1 * 12/2007 Hart ..... 473/564
2008/0113832 A1 * 5/2008 Ciesar et al. ..... 473/457
2010/0234144 A1 * 9/2010 Sutlovich et al. ..... 473/457
2010/0248867 A1 * 9/2010 Tande ..... 473/457
2011/0034275 A1 * 2/2011 Kim ..... 473/457

* cited by examiner

*Primary Examiner* — Mitra Aryanpour
(74) *Attorney, Agent, or Firm* — Paul D. Chancellor; Ocean Law

(57) ABSTRACT

A practice bat including a free sliding region provides a means for training batters to improve swing quality.

18 Claims, 7 Drawing Sheets

PRACTICE BAT

PRIORITY CLAIM

This application claims the benefit of U.S. Provisional Patent Application 61/163,707 filed 26 Mar. 2009 for PRACTICE BAT.

BACKGROUND OF THE INVENTION

Field of the Invention

The present invention relates to an article of manufacture used for practicing batting technique.

SUMMARY OF THE INVENTION

A practice bat includes an elongated shaft having a free sliding region. In an embodiment, the free sliding region is followed by a first damping region followed by a second damping region. A slider and a damper substantially surround the shaft. The slider is moved from the free sliding region toward a free end of the shaft when the shaft is swung from a handle end, the damper is pushed toward the free end of the shaft when it is impacted by the slider and the damper dissipates slider kinetic energy and tends to bring the slider to rest. The resting position of the damper relative to markings on the shaft in the first damping region is operative to indicate swing quality.

In another embodiment a practice bat comprises an elongated shaft, the shaft having a gripping region and a free sliding region. A bumper is fixed to the shaft adjacent to the free sliding region and an end stop is fixed to a distal end of the shaft. A carrier assembly including a carrier tube and a replica sports ball circumferentially engages the carrier tube and the carrier tube has a cylindrical section and a rim at one end, the rim having an outer diameter greater than that of the cylindrical section. The carrier tube circumferentially engages the shaft free sliding region. The carrier assembly is operative to translate along the shaft in response to inertial forces, the motion of the carrier tube being limited by the bumper and the end stop. Gripping and swinging the shaft causes the carrier assembly to move along the shaft free sliding region, the carrier tube to strike the end stop, the ball to break free from the carrier tube, the ball to pass over the end stop, and the ball to take flight.

BRIEF DESCRIPTION OF THE DRAWINGS

The present invention is described with reference to the accompanying figures. These figures, incorporated herein and forming part of the specification, illustrate embodiments of the present invention and, together with the description provide examples enabling a person skilled in the relevant art to make and use the invention.

DETAILED DESCRIPTION OF THE PREFERRED EMBODIMENTS

The disclosure provided in the following pages describes examples of several embodiments of the invention. The designs, figures, and description are non-limiting embodiments of the invention. Other embodiments of the disclosed device may or may not include the features described herein. Moreover, disclosed advantages and benefits may apply to only certain embodiments of the invention and should be not used to limit the disclosed inventions.

Figure 1:
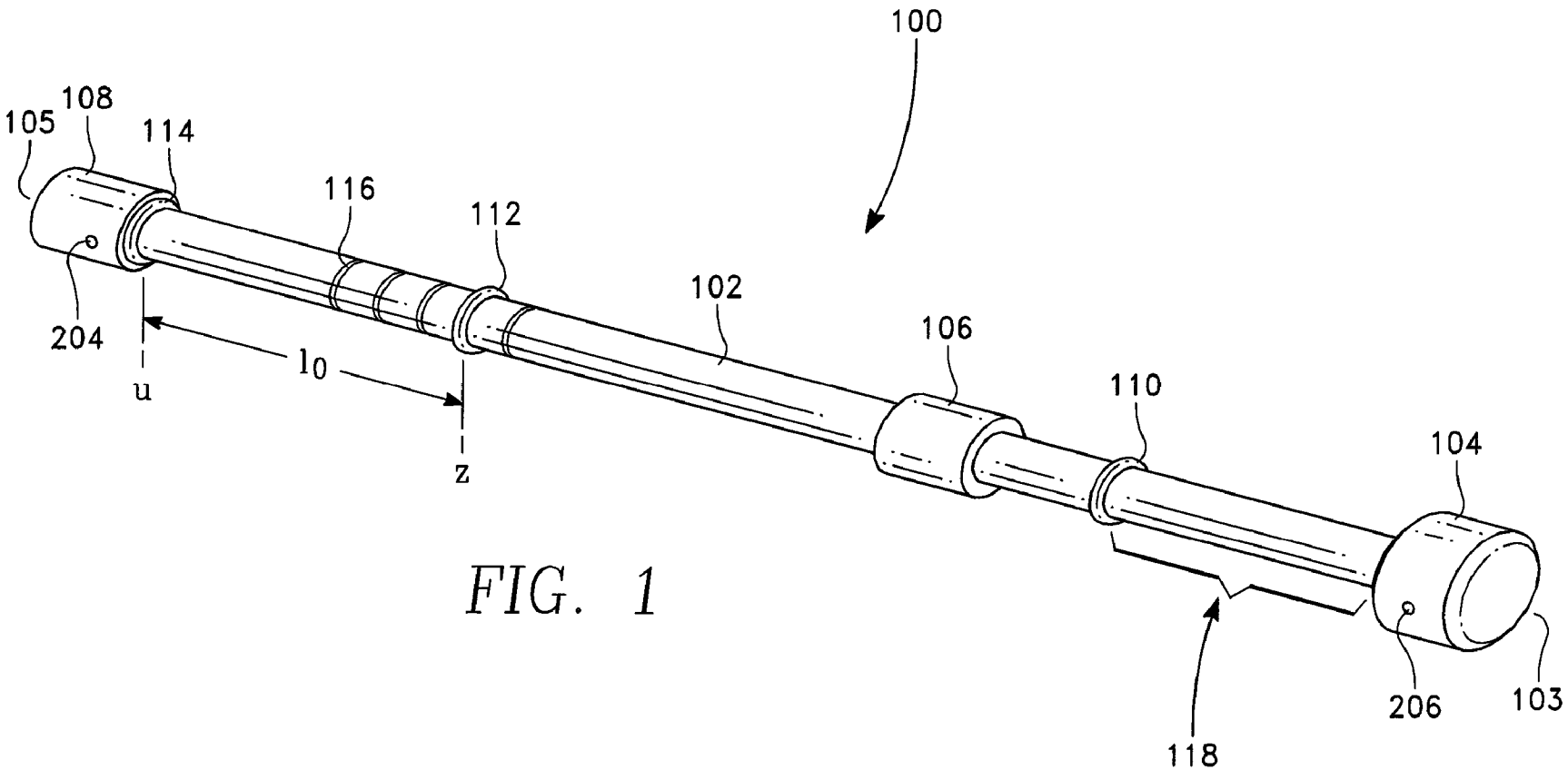
FIG. 1 is a perspective view of a practice bat in accordance with the present invention.

FIG. 1 shows a perspective view 100 of a practice bat in accordance with the present invention. An elongated shaft 102 has a handle end 103 and an opposed free end 105. Near the handle end, a shaft gripping region 118 is located between an end knob 104 and a first bumper 110 that is spaced apart from the end knob. A slider 106 that substantially encircles the shaft is located between the first bumper and a damper ring 112 and is free to move therebetween.

Figure 2:
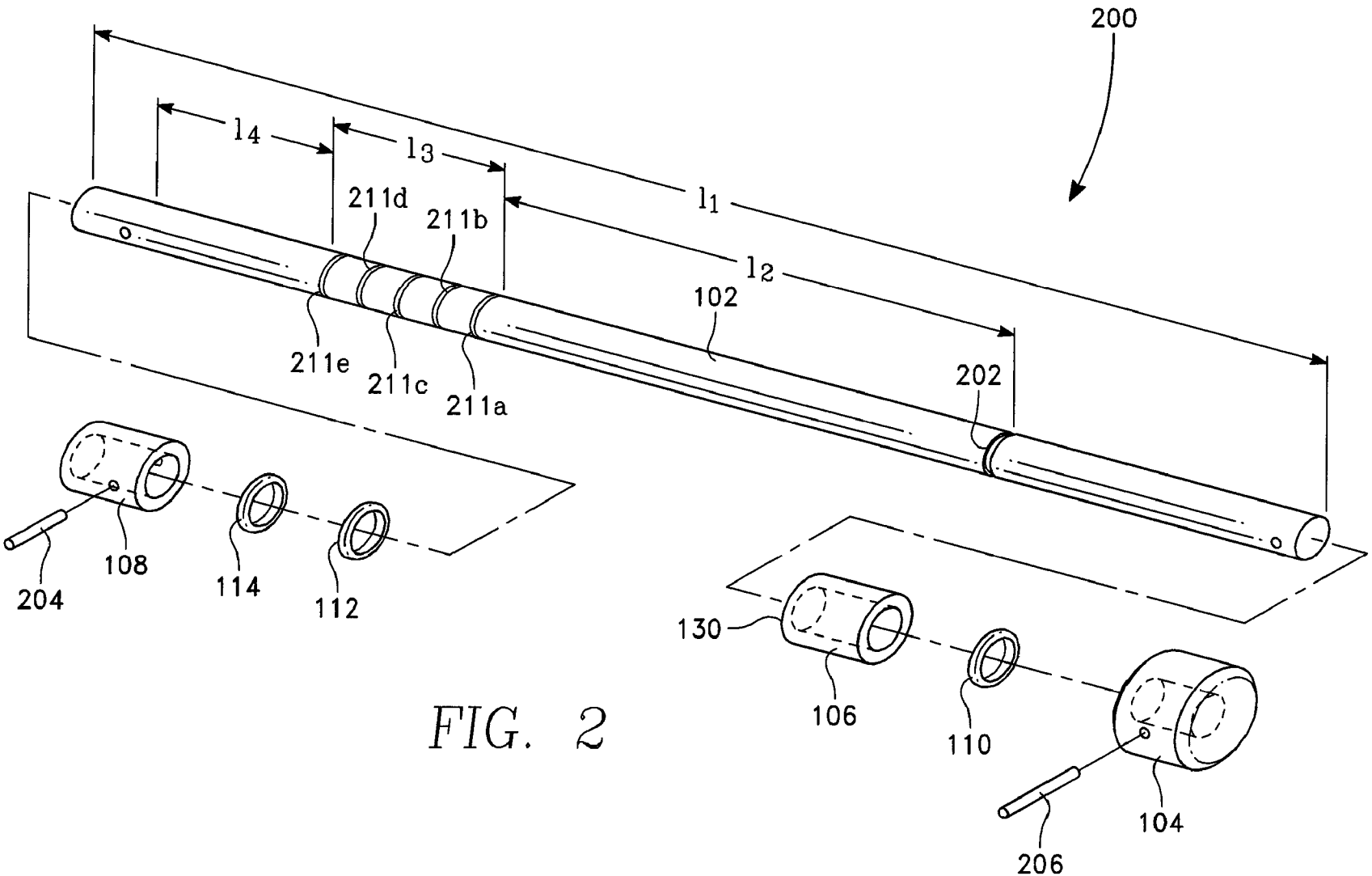
FIG. 2 is a perspective exploded view of parts of the practice bat of FIG. 1.

FIG. 2 shows an exploded view 200 of parts of the practice bat of FIG. 1. In an embodiment, an end stop 108 is fitted to the shaft 102 near the free end 105. Embodiments of the end stop having differing weights attributable to one or more of end stop dimensions, material density and end stop attachments provides a means for adjusting a bat dynamics during a swing, for example during batter training or batter warm-up.

In various embodiments, suitable means known to persons of ordinary skill in the art are used to fix or removably fix the end stop 108 to the shaft 102. Such means include pins such as roll pins 204 passing through the shaft and the end stop (as shown), similarly situated screws, similarly situated bolts, interference fits, use of adhesives, screw threads within a bore of the end piece and mating screw threads on the interfacing region of the shaft, spring loaded fasteners, other fasteners and other similar means. Where an end stop 108 is used, some embodiments include a second bumper 114 encircling the shaft 102 and abutting the end stop.

The end knob 104 is fitted to the shaft in a manner similar to that used for the end stop. In some embodiments, the end knob is fixed to the shaft using a pin such as a roll pin 206 passing through the shaft 102 and the end knob (as shown).

The shaft 102 may be made of any suitable rigid material including wood and metallic materials commonly used for ball sports bats known by persons of ordinary skill in the art. In an embodiment the shaft is tubular. In an embodiment the shaft has a hollow portion 305 (see FIG. 3). In other embodiments, the shaft is solid such as is common for a wooden baseball bat.

The damper 112 may be made of any material suited for interacting with the shaft 102 to resist relative motion therebetween. For example, one or more synthetic and natural materials are used in various embodiments including rubbers, plastics, corks, woods, and similar materials. Further, one or more rubbers such as butyl, ethylene propylene diene monomer, fluorocarbon, silicon, vulcanized, non-vulcanized and resilient rubbers are used in some embodiments. In an embodiment, the damper is an O-Ring made from a suitable elastomer such as one of the rubbers mentioned above. In various embodiments using O-Rings, the O-Ring cross-sectional shape is circular, arced or prismatic.

The first and second bumpers 110, 114 may be made of any material suited for being impacted by the slider 106. For example, one or more synthetic and natural materials with shock resistant characteristics are used in various embodiments including rubbers, plastics, corks, woods, and resilient materials. In particular, one or more plastics including PVC, ABS, HDPE, acetal resin such as DuPont Delrin® and resilient plastics are used in some embodiments. Further, one or more rubbers such as butyl, ethylene propylene diene monomer, fluorocarbon, silicon, vulcanized, non-vulcanized and resilient rubbers are used in some embodiments. In an embodiment, the bumpers are O-Rings made from a suitable elastomer such as one of the elastomers mentioned above.

The slider 106 may be made of any material suited for sliding on a shaft subjected to swinging motions and suited for impacting the above described bumpers 110, 114. In various embodiments, the slider is made from one or more of the materials suited for making bumpers and metallic materials such as alloys and/or compounds of aluminum, steel, copper, stainless steel, titanium and other suitable metals. For example, a multipart slider having a metallic body extending between plastic end pieces is used in an embodiment. In another embodiment, a plastic damper such as a PVC tube is used.

In some embodiments, the slider 106 includes an anti-friction material at a slider end-face 130 for minimizing the coefficient of friction between the end-face and the damper 112. Persons of ordinary skill in the art will understand that suitable anti-friction materials are chosen in relation to the selected damper material. In various embodiments, one or more antifriction materials containing Teflon®, silicon, nylon, polyethylene, inorganic lubricants, organic lubricants and the like is used. In some embodiments, one or both of the damper and the slider are made from one or more of these antifriction materials.

The knob 104 may be made of any material suited to rigorous use associated with a practice bat. These materials include the materials of construction of the bumpers 110, 114 listed above. The end stop 108 may be made of any material suited to rigorous use associated with a practice bat, fitment to the shaft 102 and impacts caused by the slider 106. These materials include the materials of construction of the bumpers listed above.

Along the length of the practice bat l1 there is a gripping region 118, a free sliding length or region l2 is followed by a first damping length or region l3. In an embodiment, a second damping length or region l4 follows the third damping length. Within the free sliding length, the slider 106 typically moves along the shaft 102 without being impeded by the damper ring 112. Within the first damping length, a damper ring will, if present, impede movement of the slider as the slider must push the damper ring as it translates along the first damping length toward the free end 105. Within the second damping length, a damper ring will, if present, impede movement of the slider as the slider must push the damper ring as it translates along the second damping length toward the free end.

In an embodiment, the first damper length l3 includes one or more indicators 211*a-e* for indicating position along the length of the shaft 102. For example, in the embodiment shown there are five indicators 211*a-e* in the form of marks such as marks made with colorants or pigments, deformations, embedments or the like. As shown in the figure, the marks encircle the shaft in the form of a continuous ring. In another embodiment, the marks are discontinuous such that they do not form a continuous ring around the shaft but take, for example, the form of discrete points or arc-like segments.

In an embodiment, the first bumper 110 encircles the shaft and a holding means tends to prevent movement of the bumper relative to the shaft. In some embodiments, a holding means includes a shallow circular groove 202 in the shaft in which the bumper is seated; here, a peripheral portion of the bumper protrudes above the outer surface of the shaft. In other embodiments, the holding means includes one or more of mechanical fasteners and adhesives.

Figure 3:
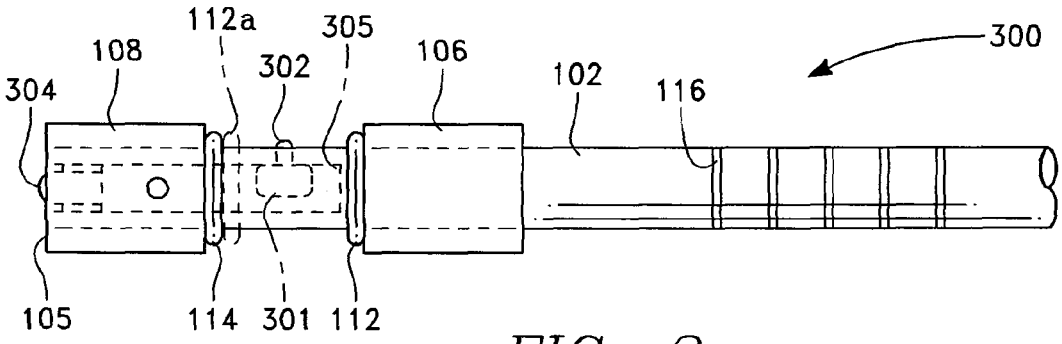
FIG. 3 is a first side view of a portion of the practice bat of FIG. 1.

FIG. 3 shows a first side view 300 of a portion of the practice bat of FIG. 1. Here, the slider 106 is shown spaced apart from the end stop 108 and abutting the damper ring 112 that is between the free end of the shaft 105 and an indicator mark 116.

Figure 4:
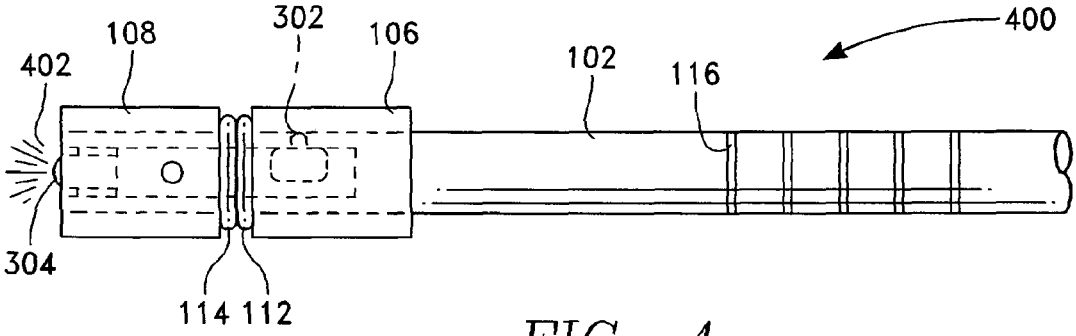
FIG. 4 is a second side view of a portion of the practice bat of FIG. 1.

FIG. 4 shows a second side view 400 of a portion of the practice bat of FIG. 1. Here, the slider 106 is shown abutting the damper ring 112 and the damper ring is shown abutting the end stop 108.

In an embodiment, an electric annunciator 304 for providing signals to a user of the practice bat is provided. Suitable annunciators include devices providing visible, audible, tactile and other signals 402 perceptible by a user of the practice bat 100. Devices providing visible signals include lamps, lights, light emitting diodes, filament devices, plasma devices, laser devices and other known devices for visible signaling. Devices providing audible signals include buzzers, horns, speakers, mechanical devices, piezoelectric devices and other known devices for aural signaling. Devices providing tactile signals include buzzers, electrical stimulators, thermal stimulators, motion stimulators, piezoelectric devices and other known devices for tactile signaling.

Where an electric annunciator 304 is used, some embodiments have no damper ring 112. Other embodiments relocate the damper ring 112*a* to abut the bumper 114 to avoid a need to reposition the damper ring after one or more swings.

Figure 5:
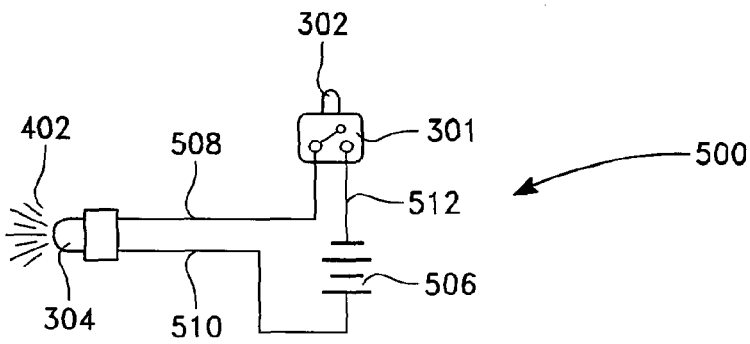
FIG. 5 is an electrical diagram of a circuit of the practice bat of FIG. 1.

In an embodiment, the practice bat 100 includes an electrical circuit including the annunciator 304. For example, FIG. 5 is an electrical diagram 500 of a circuit of the practice bat of FIG. 1. As can be seen, the annunciator 304 is actuated when a pushbutton 302 of the switch 301 closes the circuit and energy from an energy storage element such as a battery 506 flows through interconnecting electrical conductors such as wires or printed circuits 508, 510, 512 to the annunciator.

In various embodiments having an elastomeric damper, the damper slows the impacting slider 106 when, among other things, the damper drags on the shaft and/or the damper rolls on the shaft. In an embodiment, the shaft surface material and finish and the damper material are chosen to provide a suitable coefficient of friction and contact force for slowing the slider due to frictional drag between the damper and the shaft. Contact force is determined here by, among other things, the elasticity of the damper material, the thickness of the damper material and the unstretched inner diameter of the damper.

Where it is desired to prevent rolling of the damper 112 on the shaft 102, a damper having a prismatic cross-section such as a rectangular or triangular cross-section may be chosen. Here, the damper tends to stop the slider's motion relative to the shaft when, among other things, a stick-slip interaction between the shaft and the damper causes cyclic damper flexing and, among other things, conversion of kinetic energy to heat as a result of losses including mechanical hysteresis losses.

Where rolling of the damper 112 on the shaft 102 is desirable, embodiments having a damper with a circular cross section may be chosen. In such an embodiment the damper slows the slider by, among other things, cyclic flexing.

Figure 6A:
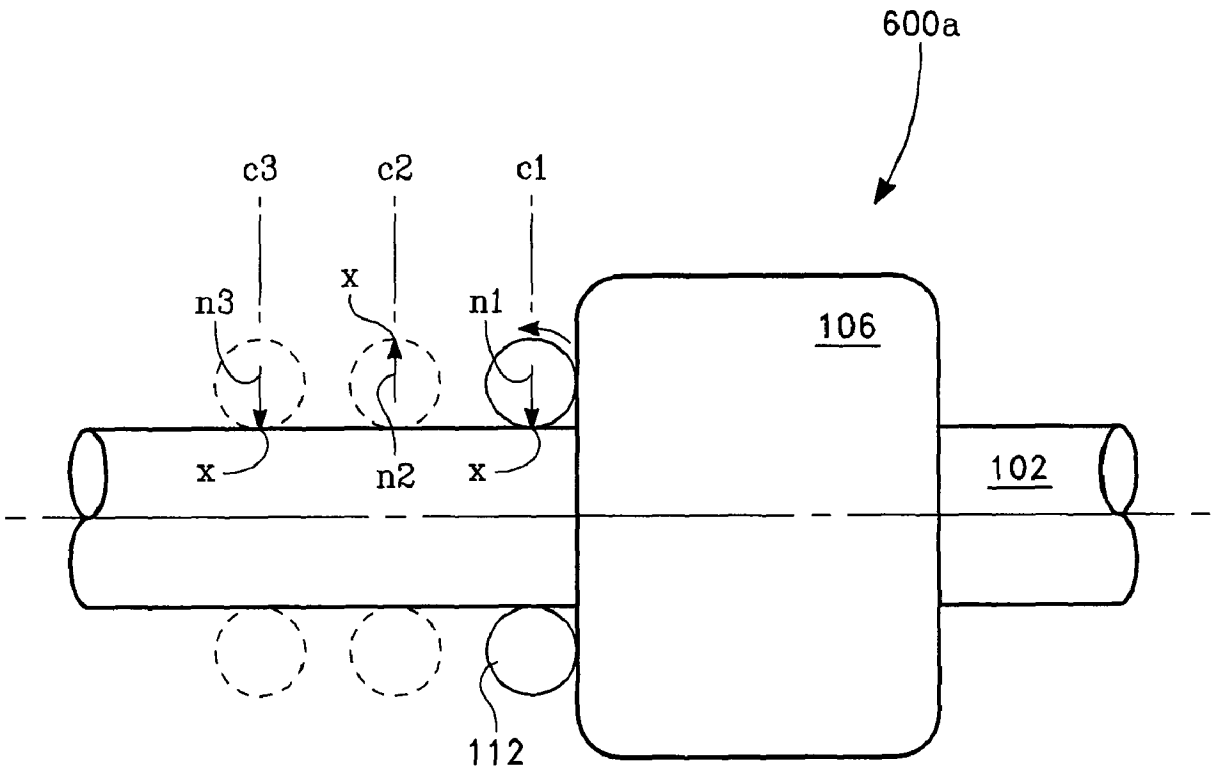
FIG. 6A is a cross-section of a portion of the practice bat of FIG. 1.

FIG. 6*a* is a cross-section 600*a* of a portion of the practice bat shaft. Shown here is the slider 106 encircling the shaft 102 and abutting an elastomeric damper 112 having a substantially circular cross-section. Positions C1, C2 and C3 indicate successive positions of the damper as it is forced along the shaft by a translating slider 106. At position C1, a point "x" on the periphery of the damper is in contact with the shaft as indicated by rotational arrow "n1." At position C2, the point "x" on the periphery of the damper is directly opposite the shaft due to rotation indicated by arrow "n2." At position C3, the point "x" on the periphery of the damper is again in contact with the shaft as indicated by arrow "n3."

Figure 6B:
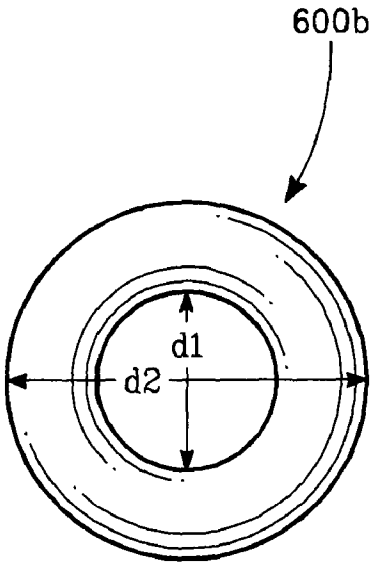
FIG. 6B is an illustration of two relevant diameters of the practice bat of FIG. 1.

FIG. 6*b* illustrates two diameters, "d1" and "d2" 600*b*. Diameter "d1" corresponds to the substantially unflexed fibers of the damper at peripheral location "x" and at position C1. Diameter "d2" corresponds to the substantially flexed fibers of the damper at the peripheral location "x" at position C2. Therefore, it is seen that cyclic flexure of a substantially circular damper 112 results when the damper rolls on the shaft. Here, the damper tends to stop the slider's motion relative to the shaft when, among other things, a rolling interaction between the shaft and the damper causes cyclic damper flexing and, among other things, conversion of kinetic energy to heat as a result of losses including mechanical hysteresis losses.

Use of the practice bat 100 is typified by a swinging motion resulting when a user grasps the gripping region 118 and swings the bat as if to make contact with a sports ball such as a baseball. As described below, the practice bat provides users and others with an indication of a batter's swing quality.

Before the swing, the damper 112 is located at a first damper position "z" that is spaced apart from the second damper by a length l0 (see FIG. 1). When preparing to swing, the practice bat 100 is raised such that it's free end 105 points generally upward and the slider 106 rests against the first bumper 110. During the swing, the slider is subjected to forces causing it to move toward the free end. Upon contacting the damper, the slider forces the damper toward the free end. The slider comes to rest when it pushes the damper against the second bumper 114 or, earlier, if the kinetic energy of the slider is dissipated by, among other things, the damper before the damper strikes the second bumper.

In FIG. 3, the position of the damper 112 and abutted slider 106 indicate that swing forces have caused the slider to push the damper toward the free end of the practice bat 105. Here, the slider has not reached its end point at position "u." In FIG. 4, the position of the damper 112 and the abutted slider 106 indicate that applied swing forces have been sufficient to cause the slider to push the damper into contact with the second bumper 114. In this case, the slider has reached its end point at position "u."

As will be appreciated by persons of ordinary skill in the art, selection of the initial damper position "z" to increase l0 also increases the work required to move the damper to the end point "u." Therefore, it is seen that l0 may be selected by a user or a user's coach to accommodate the user's ability, a particular practice exercise or a similar training goal.

Embodiments of the practice bat 100 provide signals useful for training the user. In an embodiment, the slider 106 and shaft 102 are of contrasting colors such that the position of the slider with respect to the shaft is observable during a swing or a portion of a swing. An example exercise using this feature is attempting to force the slider to position "u" at the instant the free end of the practice bat 105 reaches the desired location for striking a ball.

As discussed above, selection of l0 will influence the swing dynamics and in particular how much swinging force a user must impart to the practice bat to achieve the desired result. For example, l0 can be adjusted to match the strength of a particular player and/or in a program aimed at enhancing a player's strength. In addition, selecting "z" to coincide with a particular position indicator on the shaft 211*a-e* allows a repeatable practice regime to be established, monitored and adjusted for a particular player.

To emphasize the slider reaching position "u," some embodiments utilize audible devices to provide a signal. In an example, the damper 112 and second bumper materials are chosen to provide an audible signal resulting from their mechanical impact. In another example, an electrical annunciator provides an audible signal when a pushbutton 302 of an electrical switch 301 is depressed by interaction with the damper 112 and slider 106. In yet other embodiments, electrical devices producing visible and/or tactile signals are used to indicate a location of the slider.

In various embodiments, the practice bat 100 has either a removable end stop 108 and second bumper 114 or it does not utilize these parts. Such bats have no position "u" where the slider 106 stops due to contacting the second bumper or the end stop. A swinging force sufficient to cause the slider to push the damper off the shaft 102 results in the slider taking flight. This feature can be used to train a player's swing and in cases to emphasize swing technique for directing the flight path of the ball struck by the bat.

Figure 7A:
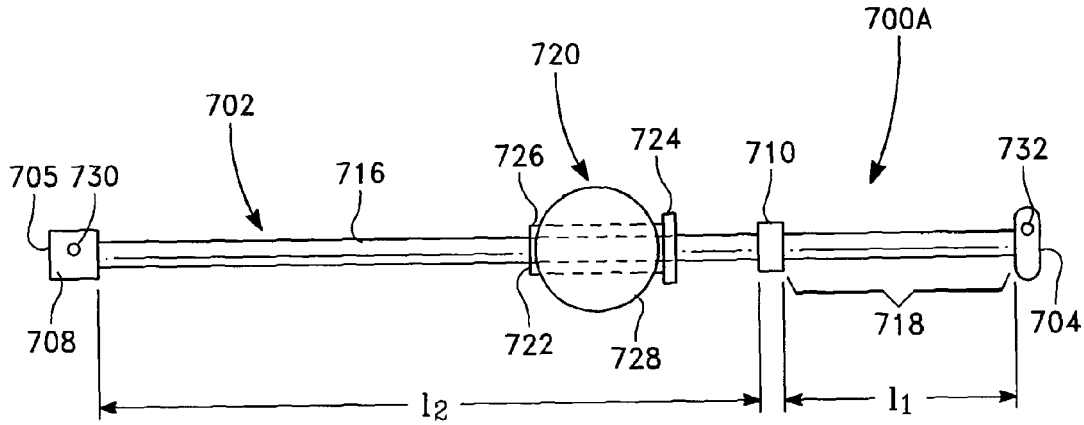
FIG. 7A illustrates a second practice bat in accordance with the present invention.

FIG. 7A shows a second practice bat in accordance with the present invention 700A. An elongated shaft 702 has a handle end 704 and an opposed free end 705. Near the handle end, a shaft gripping region 718 is located between an end knob 703 and a bumper 710 that is spaced apart from the end knob. A carrier assembly 720 is engaged with a free sliding region of the shaft 716.

The carrier assembly includes a carrier tube 722 and a ball, sports ball or replica of a sports ball 728. The carrier tube includes a cylinder 726 for engaging the shaft 716 and a ball retaining rim 724 fixed to one end of the cylinder. Notably, the cylinder and rim may be a single part or multiple parts. In various embodiments, the ball is one or more of solid, hollow, thin walled, smooth surfaced, and perforated.

Figure 8:
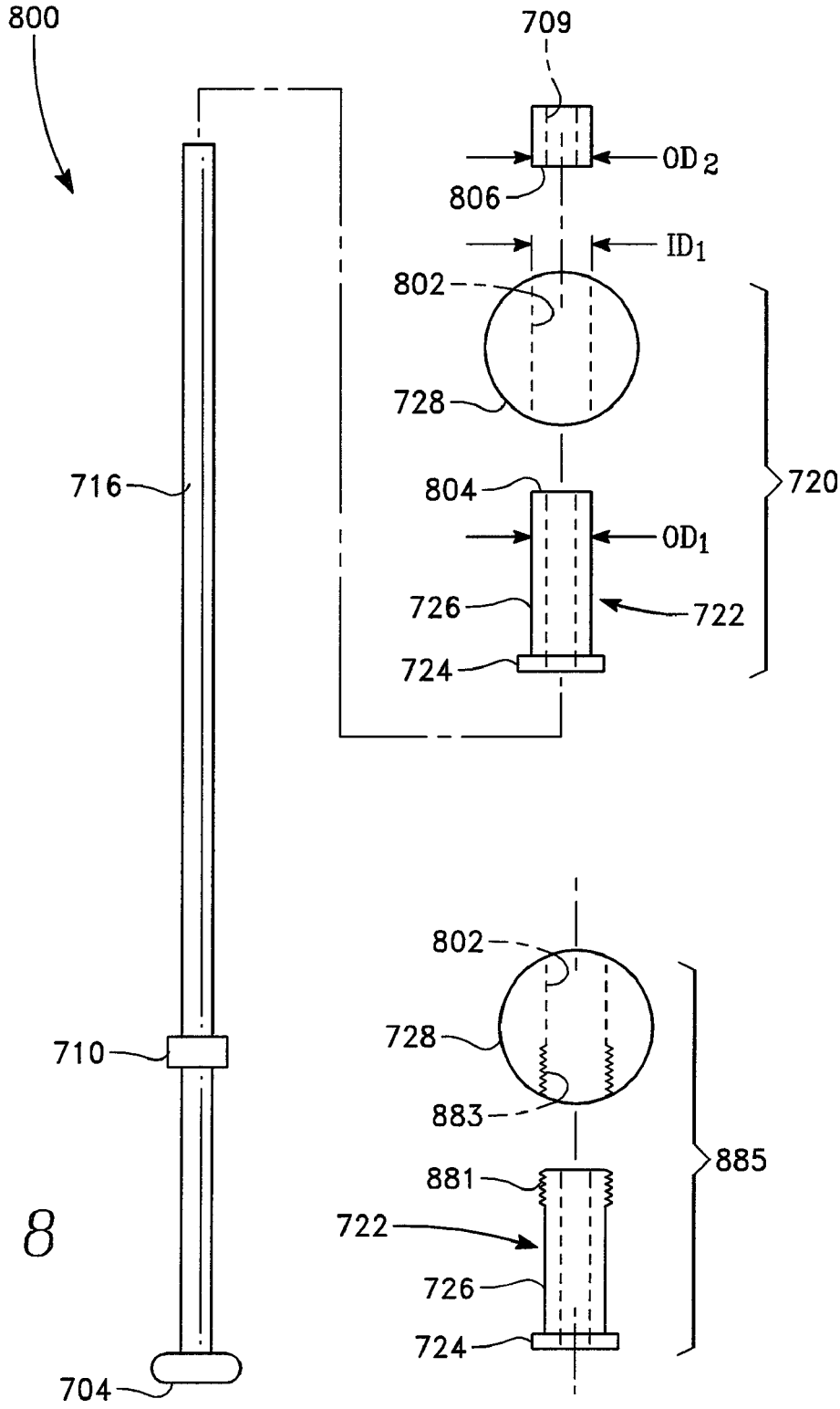
FIG. 8 is an exploded view of the parts of the practice bat of FIG. 7A.

FIG. 8 shows an exploded view 800 of parts of the practice bat of FIG. 1. In particular, the ball carrier assembly 720 is shown with the ball 728 removed from the carrier tube 722. The ball has a through bore 802 with an internal diameter ID1. The carrier tube cylinder 726 has an outside diameter OD1.

In an embodiment, there is a loose fit between the ball's bore ID1 and the carrier tube cylinder's outer diameter OD1. For example, the ball's bore is about 0.1% to 5% larger than the carrier tube cylinder's outer diameter. And, in an embodiment, there is an interference fit between the ball's bore ID1 and the carrier tube cylinder's outer diameter OD1. For example, the ball's bore is about 0.1% to 1% smaller than the carrier tube cylinder's outer diameter. In some embodiments 885 (see FIG. 8), the carrier tube cylinder 726 has ridges 881 engaged by projections 883 from the bore 802 of the ball.

In various embodiments, the ball 728 is hollow and in various embodiments the ball is solid. The ball has a borehole 802 for receiving the shaft 716. For example, a thin-walled hollow ball such as a WIFFLE® ball is used in some embodiments.

In an embodiment, an end stop 708 is fitted to the shaft 702 near the free end 705. The end stop has a through bore 709 for receiving the shaft 716 and an outer diameter shown as OD2. End stop outer diameter OD2 is equal to or less than the inner diameter of the ball ID1. Embodiments of the end stop having differing weights attributable to one or more of end stop dimensions, material density, and end stop attachments provide a means for varying bat swing dynamics, for example during batter training or batter warm-up.

In various embodiments, suitable means known to persons of ordinary skill in the art are used to fix or removably fix the end stop 708 to the shaft 702. Such means include a knob that is integral with the shaft 920 and a knob that is fastened to the shaft. Fastening means include pins such as roll pins 730 passing through the shaft and the end stop (as shown in FIG. 7A), similarly situated screws, similarly situated bolts, interference fits, use of adhesives, screw threads within a bore of the end piece and mating screw threads on the interfacing region of the shaft, spring loaded fasteners, other fasteners and other similar means.

The end knob 704 is fitted to the shaft in a manner similar to that used for the end stop. In some embodiments, the end knob is fixed to the shaft using a pin such as a roll pin 732 passing through the shaft 702 and the end knob (as shown in FIG. 7A).

The shaft 702 may be made of any suitable rigid material including wood and metallic materials commonly used for ball sports bats known by persons of ordinary skill in the art. In an embodiment the shaft is tubular. In other embodiments, the shaft is solid such as is common for a wooden baseball bat.

In some embodiments, a damper (see for example FIG. 1) encircles the shaft 716 between the carrier assembly 720 and the end stop 708. The damper 112 may be made of any material suited for interacting with the shaft 102 to resist relative motion therebetween. For example, one or more synthetic and natural materials are used in various embodiments including rubbers, plastics, corks, woods, and similar materials. Further, one or more rubbers such as butyl, ethylene propylene diene monomer, fluorocarbon, silicon, vulcanized, non-vulcanized and resilient rubbers are used in some embodiments. In an embodiment, the damper is an O-Ring made from a suitable elastomer such as one of the rubbers mentioned above. In various embodiments using O-Rings, the O-Ring cross-sectional shape is circular, arced or prismatic.

The bumper 710 and the end stop 708 are preferably made from a material suited for being impacted by the carrier tube 722. In some embodiments, the bumper and or end stop material is selected to enhance impact sounds when the bumper or end stop is struck by the carrier tube. In an embodiment, the bumper is made from a metal such as steel or aluminum. In other embodiments one or more synthetic and natural materials with shock resistant characteristics are used including rubbers, plastics, corks, woods, and resilient materials. In particular, one or more plastics including PVC, ABS, HDPE, acetal resin such as DuPont Delrin® and resilient plastics are used in some embodiments. Further, one or more rubbers such as butyl, ethylene propylene diene monomer, fluorocarbon, silicon, vulcanized, non-vulcanized and resilient rubbers are used in some embodiments.

The carrier tube 722 may be made of any material suited for sliding on a shaft subjected to swinging motions and suited for impacting the above described bumper 710 and end stop 708. In various embodiments, the slider is made from one or more of the materials suited for making bumpers and metallic materials such as alloys and/or compounds of aluminum, steel, copper, stainless steel, titanium and other suitable metals. In some embodiments the carrier tube is made from a polymer such as a plastic. Suitable plastics include thermoplastic elastomers, PVC, ABS, and HDPE materials.

The knob 704 may be made of any material suited to rigorous use associated with a practice bat. These materials include the materials of construction of the bumper 710 listed above. The end stop 708 may be made of any material suited to rigorous use associated with a practice bat, fitment to the shaft 702 and impacts caused by the slider carrier tube 722. These materials include the materials of construction of the bumpers listed above.

Along the length of the practice bat there is a gripping region 718 denoted by length l1 and a free sliding region denoted by length l2. The carrier assembly 720 is free to move along the free sliding region. The ball 728 is movable with respect to the carrier tube cylinder 726 in response to inertial forces such as swing forces.

Use of the practice bat 700A is typified by a swinging motion resulting when a user grasps the gripping region 718 and swings the bat as if to make contact with a sports ball such as a baseball. As described below, the practice bat provides users and others with an indication of a batter's swing quality.

Before the swing, the carrier assembly 720 is located adjacent to the bumper 710. When preparing to swing, the practice bat 700A is raised such that it's free end 705 points generally upward and the carrier assembly 720 rest against the bumper 710. During the swing, the carrier assembly is subjected to forces causing it to move toward the free end 705.

Figure 7B:
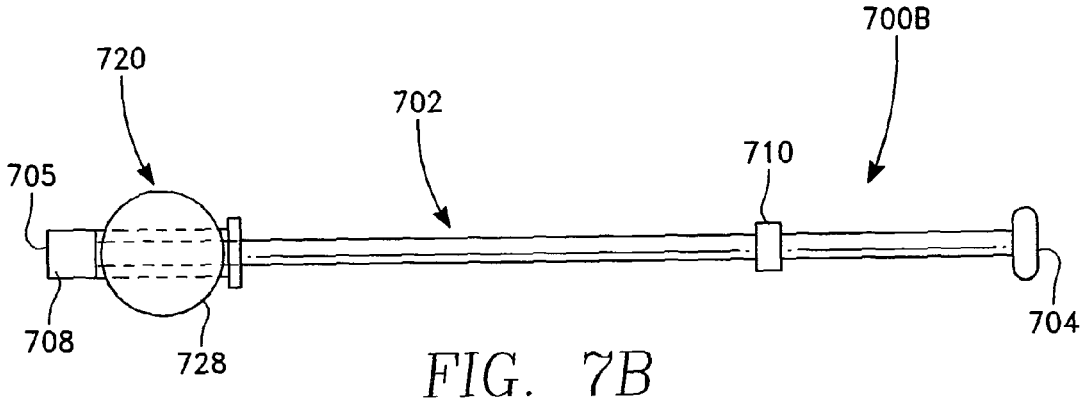
FIG. 7B illustrates the practice bat of FIG. 7A with the carrier assembly in a second position.

FIG. 7B shows the carrier assembly with ball in a second position 700B. Here, the carrier assembly has moved along the free sliding region of the shaft 716 through length l2. When a front face of the carrier tube cylinder 804 strikes a mating face of the end stop 806, the inertia of the sports ball 728 overcomes the interference fit and/or latching action between the ball and the carrier tube cylinder. Now moving relative to the carrier tube cylinder, the ball passes over the end stop.

Figure 7C:
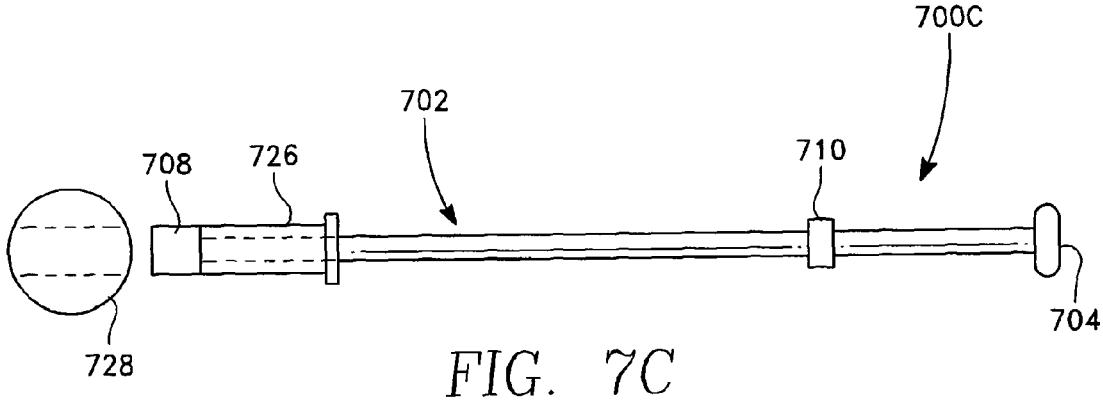
FIG. 7C illustrates the practice bat of FIG. 7A with the carrier assembly in a third position.

FIG. 7C show the ball 708 in a third position 700C. Here, the ball has passed completely over the end stop and is no longer restrained by a coupling to the bat shaft 702. Free of the bat shaft, the ball takes flight and travels in a direction pointed to by the shaft at the moment the ball leaves the shaft.

Embodiments of the practice bat 700A provide signals useful for training the user. In an embodiment, the carrier assembly 720 and shaft 702 are of contrasting colors such that the position of the carrier with respect to the shaft is observable during a swing or a portion of a swing.

To emphasize the carrier assembly 720 reaching the end stop 708, some embodiments utilize audible devices to provide a signal. In an example, the carrier tube 726 and end stop materials are chosen to provide an audible signal resulting from their mechanical impact. In another example similar to that shown in FIG. 3 above, an electrical annunciator provides an audible signal. In yet other embodiments, electrical devices producing visible and/or tactile signals are used to indicate a location of the carrier assembly.

Figure 9:
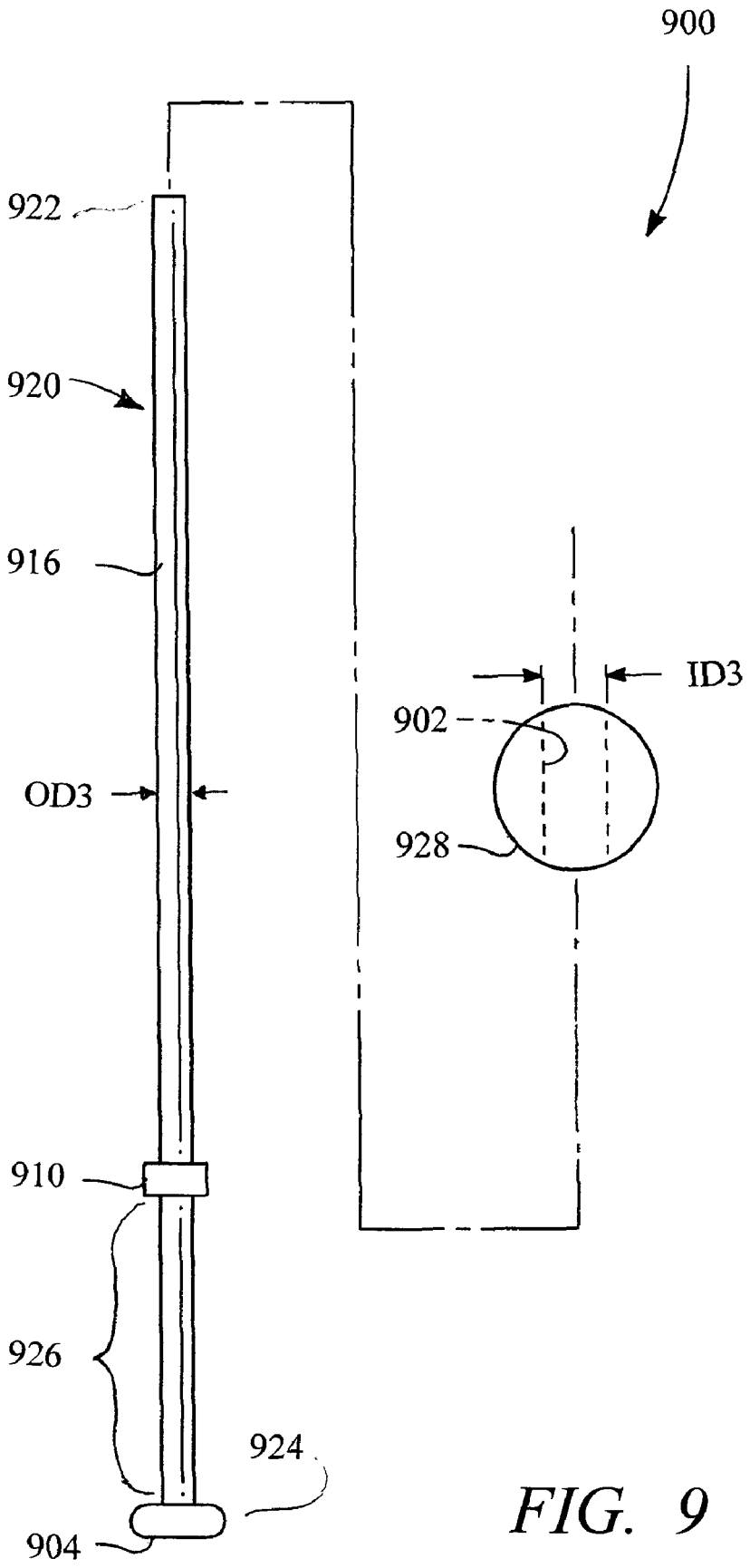
FIG. 9 is an exploded view of a third practice bat in accordance with the present invention.

FIG. 9 shows an exploded view of a third practice bat in accordance with the present invention 900. This bat is similar to the bat shown in FIG. 7A above, the most significant difference being the lack of a carrier assembly 720.

An elongated shaft 920 has a handle end 924 and an opposed free end 922. Near the handle end, a shaft gripping region 926 is located between an end knob 904 and a bumper 910 that is spaced apart from the end knob. In various embodiments, either or both of the bumper and the end knob are integral with the shaft. In yet other embodiments, either or both of the bumper and the end knob are not integral with the shaft.

A ball 928 is for engaging the shaft 920. The ball has a through bore 902 with an internal diameter ID3. A free length of the shaft 916 with an outer diameter OD3 is for mating with the through bore of the ball. In various embodiments, the ball is one or more of solid, hollow, thin walled, smooth surfaced, and perforated. For example, a thin-walled hollow ball such as a WIFFLE® ball is used in some embodiments.

In an embodiment, there is a loose fit between the ball's bore ID3 and the shaft outer diameter OD3. For example, the ball's bore is about 0.1% to 5% larger than the shaft outer diameter OD3. And, in an embodiment, there is an interference fit between the ball's bore ID3 and the shaft's outer diameter OD3. For example, the ball's bore is about 0.1% to 1% smaller than the shaft's outer diameter OD3.

In various embodiments, suitable means known to persons of ordinary skill in the art are used to fix or removably fix the knob 904. Such means include a knob that is integral with the shaft 920 and a knob that is fastened to the shaft. Fastening means include pins such as roll pins 730 passing through the shaft and the end stop (as shown in FIG. 7A), similarly situated screws, similarly situated bolts, interference fits, use of adhesives, screw threads within a bore of the end piece and mating screw threads on the interfacing region of the shaft, spring loaded fasteners, other fasteners and other similar means.

The shaft 702 may be made of any suitable rigid material including wood and metallic materials commonly used for ball sports bats known by persons of ordinary skill in the art. In an embodiment the shaft is tubular. In other embodiments, the shaft is solid such as is common for a wooden baseball bat.

The bumper 910 is preferably made from a material suited for interfacing with the ball 928. In an embodiment, the bumper is made from a metal such as steel or aluminum. In other embodiments one or more synthetic and natural materials are used including rubbers, plastics, corks, woods, and resilient materials. In particular, one or more plastics including PVC, ABS, HDPE, acetal resin such as DuPont Delrin® and resilient plastics are used in some embodiments. Further, one or more rubbers such as butyl, ethylene propylene diene monomer, fluorocarbon, silicon, vulcanized, non-vulcanized and resilient rubbers are used in some embodiments.

The knob 704 may be made of any material suited to rigorous use associated with a practice bat. These materials include the materials of construction of the bumper 710 listed above.

Along the length of the practice bat there is a gripping region 926 and a free sliding region 916. The ball 928 is free to move along the free sliding region in response to inertial forces such as swing forces.

Use of the practice bat 900 is typified by a swinging motion resulting when a user grasps the gripping region 926 and swings the bat as if to make contact with a sports ball such as a baseball. As described below, the practice bat provides users and others with an indication of a batter's swing quality.

Before the swing, the ball 928 is located adjacent to the bumper 910. When preparing to swing, the practice bat 900 is raised such that its free end 922 points generally upward and the ball rests against the bumper 910. During the swing, the ball is subjected to forces causing it to move toward the free end 922.

While the batter's swing is in progress, the ball 928 moves away from the bumper 910, along the bat's free sliding region 916, and toward the bat's free end 922. Near the end of the batter's swing, the ball passes over the bat's free end and takes flight, generally traveling in a direction pointed to by the shaft at the moment the ball leaves the shaft 920.

Embodiments of the practice bat 900 provide signals useful for training the user. In an embodiment, the ball 928 and the shaft 920 are of contrasting colors such that the position of the carrier with respect to the shaft is observable during a swing or a portion of a swing.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. A practice bat comprising:

an elongated shaft;

the shaft having a free sliding region adjacent to a first damping region;

a slider and a damper substantially surrounding the shaft;

the slider being moved from the free sliding region toward a free end of the shaft when the shaft is swung from a handle end;

the damper being pushed toward the free end of the shaft when the damper is impacted by the slider;

the damper dissipating slider kinetic energy and tending to bring the slider to rest; and, the resting position of the damper relative to markings on the shaft in the first damping region operative to indicate swing quality.

2. The practice bat of claim 1 further comprising: a second damping region;

the second damping region located between an end stop and the first damping region; and, sufficient swing force operable to move the damper beyond the first damping region and into the second damping region.

3. The practice bat of claim 2 further comprising: first and second bumpers for limiting the range of motion of the slider;

the first bumper being located between a shaft gripping region and the free sliding region; and, the second bumper being located adjacent to the end stop.

4. The practice bat of claim 3 further comprising an electrical circuit and an annunciator.

5. The practice bat of claim 4 further comprising: a switch having a pushbutton projecting from the shaft near the end stop; and, the switch operable to actuate the annunciator when the slider presses the pushbutton toward a centerline of the shaft.

6. A practice bat comprising:

an elongated shaft;

the shaft having a gripping region and a free sliding region;

a bumper fixed to the shaft adjacent to the free sliding region;

an end stop fixed to a distal end of the shaft;

a carrier assembly including a carrier tube and a replica sports ball circumferentially engaging the carrier tube;

the carrier tube having a cylindrical section and a rim at one end, the rim having an outer diameter greater than that of the cylindrical section;

the carrier tube circumferentially engaging the shaft free sliding region;

the carrier assembly operative to translate along the shaft in response to inertial forces, the motion of the carrier tube being limited by the bumper and the end stop; and, wherein gripping and swinging the shaft causes
the carrier assembly to move along the shaft free sliding region,
the carrier tube to strike the end stop,
the replica sports ball to break free from the carrier tube,
the replica sports ball to pass over the end stop, and
the replica sports ball to take flight.

7. The practice bat of claim 6 wherein the bumper is integral with the shaft.

8. The practice bat of claim 6 further comprising a series of ridges on an outer surface of the carrier tube, the ridges operative to engage a projection from a bore of the replica sports ball and tend to restrain motion of the replica sports ball relative to the carrier tube.

9. The practice bat of claim 8 wherein the ball is hollow and the ball wall thickness is selected to engage the ridges on the carrier tube.

10. The practice bat of claim 9 wherein the ball wall is perforated.

11. A practice bat comprising:
an elongated shaft;
the shaft having a gripping region and a free sliding region;
a bumper fixed to the shaft adjacent to the free sliding region;
a replica sports ball circumferentially engaging the free sliding region;
the ball operative to translate along the shaft in response to inertial forces, the motion of the ball being limited by the bumper; and,
wherein gripping and swinging the shaft causes
the ball to move along the shaft free sliding region,
the ball to pass over a free end of the shaft, and
the ball to take flight.

12. The practice bat of claim 11 wherein the bumper is integral with the shaft.

13. The practice bat of claim 8 wherein the replica sports ball is hollow.

14. The practice bat of claim 9 wherein the replica sports ball wall is perforated.

15. A practice bat comprising:
an elongated shaft;
the shaft having a gripping region and a free sliding region;
a bumper fixed to the shaft adjacent to the free sliding region;
an end stop fixed near a distal end of the shaft;
a carrier assembly including a carrier tube and a replica sports ball encircling the carrier tube;
the carrier tube having a cylindrical section and a rim at one end, the rim facing the bumper and having an outer diameter greater than that of the cylindrical section;
the carrier tube encircling the shaft free sliding region;
the carrier assembly operative to translate along the shaft in response to inertial forces, the motion of the carrier tube being limited by the end stop; and,
wherein gripping and swinging the shaft causes
the carrier assembly to move along the shaft free sliding region,
the carrier tube to strike the end stop,
the replica sports ball to separate from the carrier tube,
the replica sports ball to pass over the end stop, and
the replica sports ball to take flight.

16. The practice bat of claim 15 further including a hole in the replica sports ball that enables the ball to pass over the end stop.

17. The practice bat of claim 15 wherein the replica sports ball encircles a majority of the length of the carrier tube.

18. The practice bat of claim 17 wherein the carrier tube encircles a minority of the length of the free sliding region.

* * * * *